US010612736B2

(12) United States Patent
Zaderej et al.

(10) Patent No.: US 10,612,736 B2
(45) Date of Patent: Apr. 7, 2020

(54) LUMINAIRE

(71) Applicant: Molex, LLC, Lisle, IL (US)

(72) Inventors: Victor Zaderej, Wheaton, IL (US); Marko Spiegel, LaFox, IL (US); Christopher Blount, Naperville, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/502,951

(22) PCT Filed: Aug. 24, 2015

(86) PCT No.: PCT/US2015/046545

§ 371 (c)(1),
(2) Date: Feb. 9, 2017

(87) PCT Pub. No.: WO2016/032961

PCT Pub. Date: Mar. 3, 2016

(65) Prior Publication Data

US 2017/0234495 A1 Aug. 17, 2017

Related U.S. Application Data

(60) Provisional application No. 62/041,170, filed on Aug. 25, 2014.

(51) Int. Cl.

| | |
|---|---|
| ***F21S 8/02*** | (2006.01) |
| ***F21S 8/04*** | (2006.01) |
| ***F21V 23/06*** | (2006.01) |
| ***F21V 3/00*** | (2015.01) |
| ***F21V 7/04*** | (2006.01) |

(Continued)

(52) U.S. Cl.

CPC ..... *F21S 8/026* (2013.01); *F21S 8/04* (2013.01); *F21V 3/00* (2013.01); *F21V 7/04* (2013.01); *F21V 23/06* (2013.01); *H05B 33/0842* (2013.01); *H05B 37/0263* (2013.01); *F21Y 2103/10* (2016.08); *F21Y 2115/10* (2016.08)

(58) Field of Classification Search

CPC .... F21V 19/003–0055; F21S 8/02–028; F21S 8/03; F21S 8/043

See application file for complete search history.

(56) References Cited

U.S. PATENT DOCUMENTS 7,654,702 B1 * 2/2010 Ding ..... F21V 29/004 362/218
8,011,794 B1 9/2011 Sivertsen (Continued)

FOREIGN PATENT DOCUMENTS

CN 101725940 A 6/2010
CN 201771131 U 3/2011

(Continued)

OTHER PUBLICATIONS

Office Action Received for Chinese Patent Application No. 201580045118.9, dated Nov. 23, 2018, 14 pages (Including English Translation).

(Continued)

*Primary Examiner* — Mariceli Santiago
(74) *Attorney, Agent, or Firm* — Molex, LLC

(57) ABSTRACT

A luminaire with a removable rail is disclosed. The luminaire can be powered with power provided by a power over Ethernet (POE) solution.

10 Claims, 10 Drawing Sheets

(51) Int. Cl.

| | |
|---|---|
| ***H05B 33/08*** | (2020.01) |
| ***H05B 37/02*** | (2006.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 8,061,867 | B2 * | 11/2011 | Kim | F21S 8/026 362/217.01 |
| 9,188,294 | B1 * | 11/2015 | Wegner | F21S 8/026 |
| 9,228,727 | B2 * | 1/2016 | May | F21V 3/0625 |
| 9,482,392 | B2 * | 11/2016 | Baumeister | F21K 9/27 |
| 2004/0001344 | A1 * | 1/2004 | Hecht | F21V 7/005 362/555 |
| 2010/0327768 | A1 * | 12/2010 | Kong | F21V 23/06 315/294 |
| 2011/0043132 | A1 * | 2/2011 | Kim | F21S 8/026 315/294 |
| 2012/0051041 | A1 * | 3/2012 | Edmond | F21S 8/026 362/231 |
| 2012/0293999 | A1 | 11/2012 | Chung et al. | |
| 2014/0265930 | A1 * | 9/2014 | Harris | H05B 33/0842 315/307 |
| 2014/0301074 | A1 * | 10/2014 | Miskin | F21S 8/04 362/235 |
| 2015/0195883 | A1 * | 7/2015 | Harris | H05B 33/0845 315/155 |
| 2016/0286619 | A1 * | 9/2016 | Roberts | H05B 33/0854 |
| 2017/0227173 | A1 * | 8/2017 | May | F21K 9/272 |

FOREIGN PATENT DOCUMENTS

| | | | |
|---|---|---|---|
| CN | 102042500 | A | 5/2011 |
| CN | 201897103 | U | 7/2011 |
| CN | 202812959 | U | 3/2013 |
| CN | 203024105 | U | 6/2013 |
| CN | 103201557 | A | 7/2013 |
| CN | 203312571 | U | 11/2013 |
| CN | 103470967 | A | 12/2013 |
| CN | 203501001 | U | 3/2014 |
| CN | 102042522 | B | 12/2014 |
| KR | 20080079359 | A | 9/2008 |
| KR | 10-0948115 | B1 | 3/2010 |
| KR | 10-1257812 | B1 | 4/2013 |
| KR | 2013-0063988 | A | 6/2013 |
| TW | 595686 | U | 6/2004 |
| TW | M327964 | U | 3/2008 |
| TW | M347531 | U | 12/2008 |
| WO | WO 2008/105595 | A1 | 9/2008 |
| WO | 2016032961 | A1 | 3/2016 |

OTHER PUBLICATIONS

International Search Report and Written Opinion Received for PCT Application No. PCT/US2015/046545, dated Oct. 28, 2015, 7 pages.

International Preliminary Report on Patentability Received for PCT Application No. PCT/US2015/046545, dated Mar. 9, 2017, 5 pages.

* cited by examiner

LUMINAIRE

RELATED APPLICATIONS

This application claims priority to U.S. Provisional Application No. 62/041,170, filed Aug. 25, 2014, which is incorporated herein by reference in its entirety.

TECHNICAL FIELD

This disclosure relates to field of illumination, more specifically to the field of illumination with a light emitting diode (LED).

DESCRIPTION OF RELATED ART

LEDs as a general means of illumination have become increasing popular. Recent developments have shown that LEDs can provide an efficient light source, and lab results show that certain LEDs can approach or even exceed 150 lumens/watt. In addition, LEDs avoid the need for the use of mercury, thus providing a friendlier environmental footprint than other conventional illumination technologies.

While LEDs are useful for illumination, one issue that exists is the expense of installing LED fixtures. One method to address this is to develop LED-based designs that are compatible with existing bulbs. While this can be done, it generally is suboptimal due to the fact that design tradeoffs needed to allow LEDs to function in existing fixtures tends to do a poor job of efficiently using the light provided by LEDs. More optimized fixtures would tend to be more effective at efficiently directing the emitted lumens on the desired surfaces.

In many facilities, a significant portion of the electricity being consumed is directed towards illumination. Even with the substantial increases in efficiency, it is still desirable to minimize the use of the electricity when feasible. By increasing the intelligence of the system, it is expected that further improvements in the efficacy of a building system can be provided.

While use is one portion of the efficiency of a system, another portion of the efficiency is the cost to install and maintain the illumination system. LEDs, due to their long life and gradual decrease in output, are well suited to commercial facilities. Instead of being replaced every 10,000 hours, for example, they can be replaced every 50,000 or more hours. This longevity can substantially increase the ROI as commercial facilities must pay someone to replace bulbs and often the replacement requires positioning someone near a ceiling that is more than 10 feet above the ground (potentially requiring the use of lifts or other means to safely position the person in the appropriate position).

Existing LED fixtures, however, while offering long life, often fail to provide a simple installation process. For improved safety, it would be helpful if the installation process could be done with one hand. It further would be beneficial if the luminaire could be used in a more intelligent manner. Thus, certain individuals would appreciate improvements to existing luminaires.

SUMMARY

A luminaire includes a housing with a reflective chamber. A rail is positioned near the chamber and is configured to emit light into the chamber. The light is reflected from the chamber and passes through a cover (or covers) that can act to ensure the emitted light is desirably diffuse.

BRIEF DESCRIPTION OF THE DRAWINGS

The present invention is illustrated by way of example and not limited in the accompanying figures in which like reference numerals indicate similar elements and in which.

DETAILED DESCRIPTION

Figure 1:
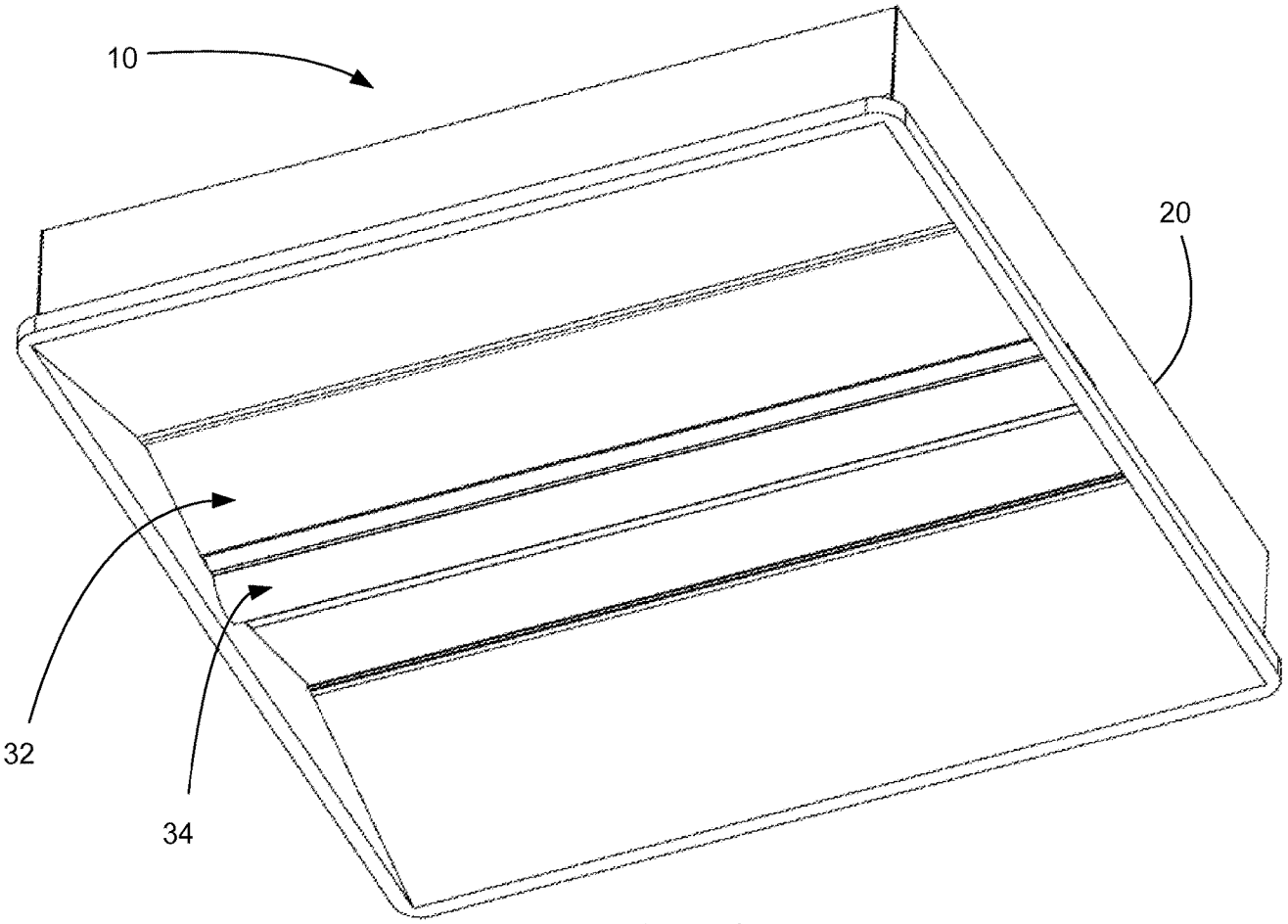
FIGS. 1-10 illustrate features of structures and technology that can be used in combination to provide a desirable luminaire.
Figure 2:
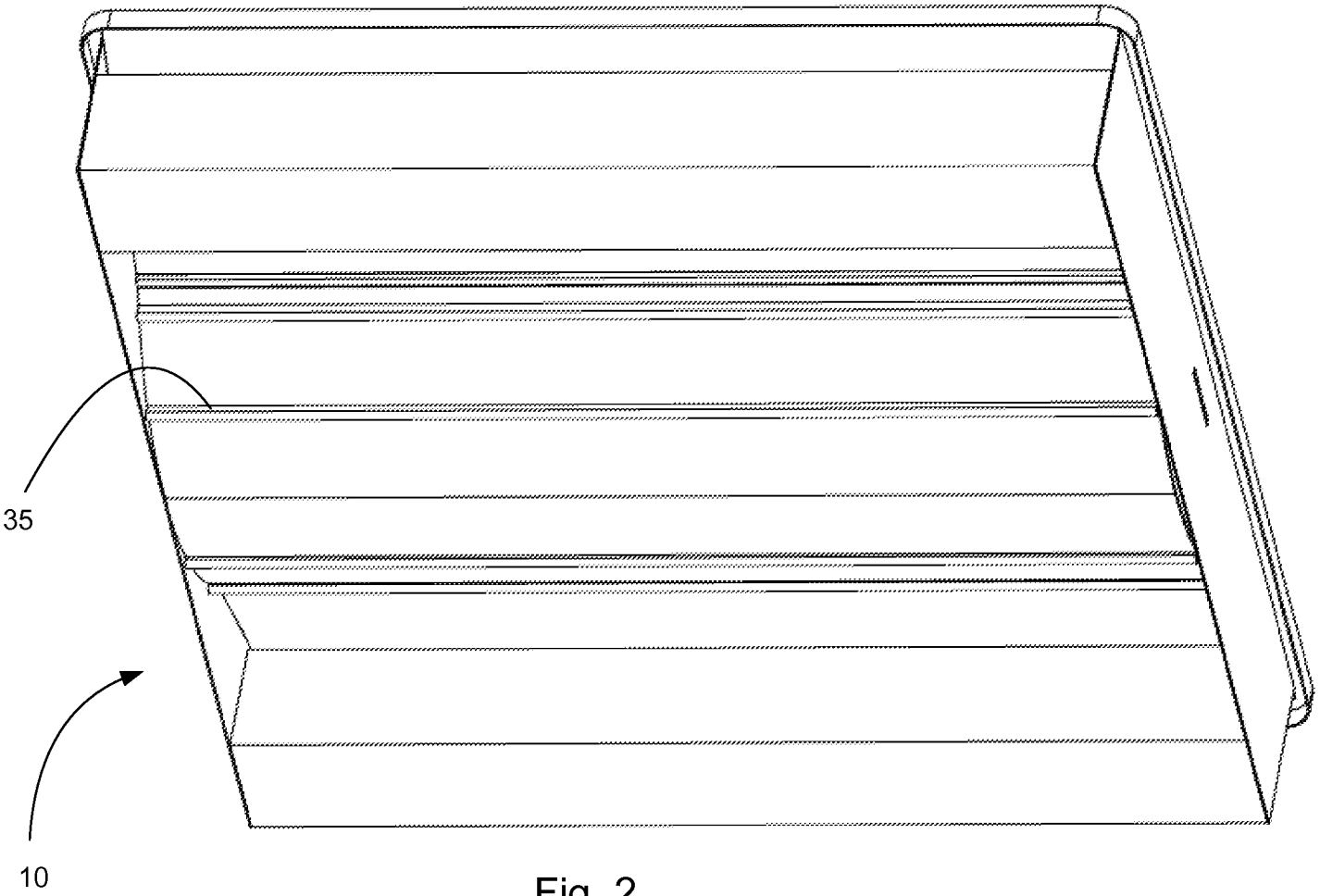
Figure 3:
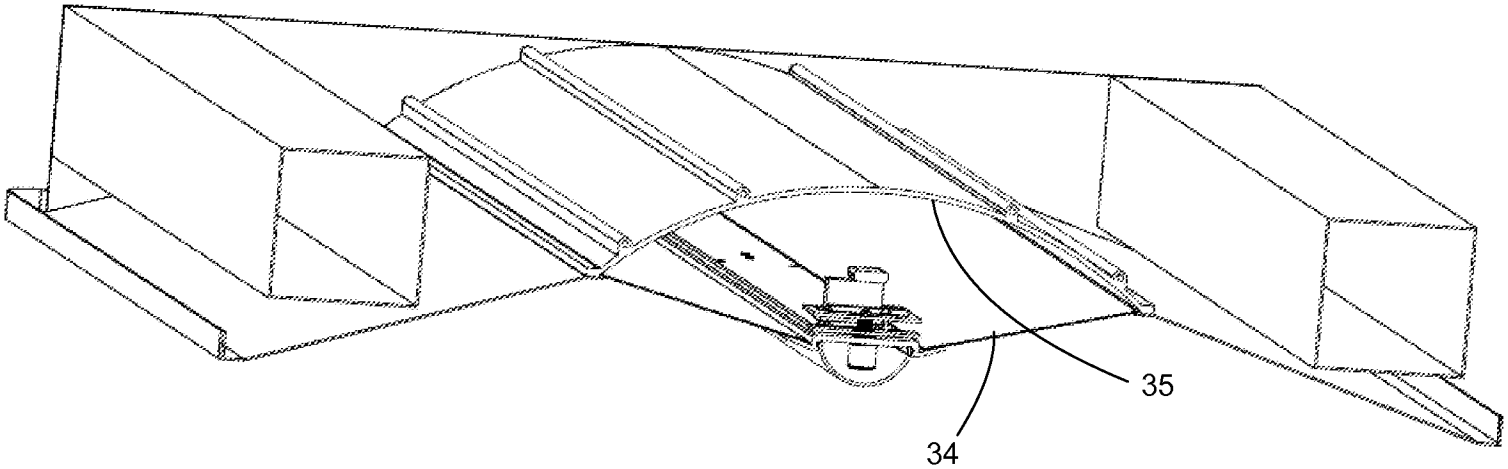
Figure 4:
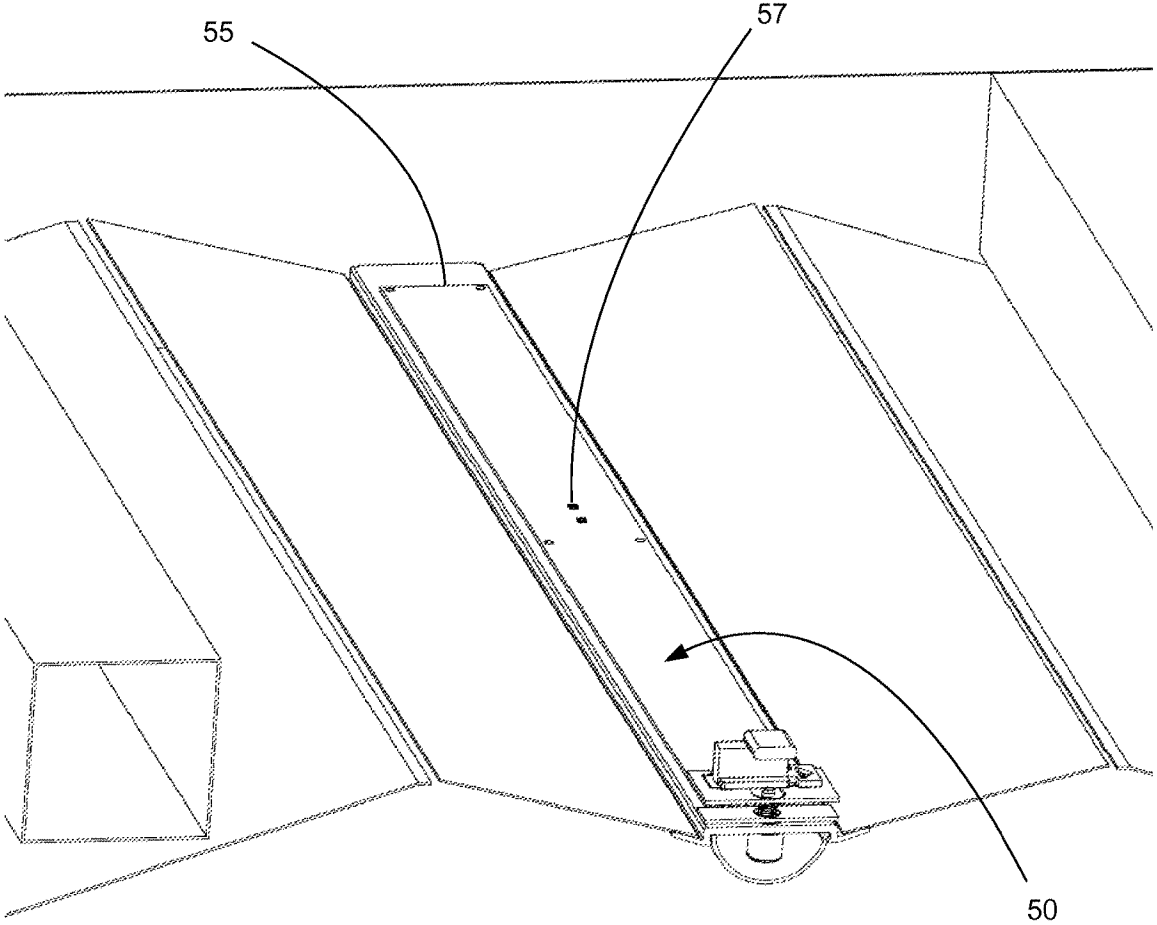
Figure 5:
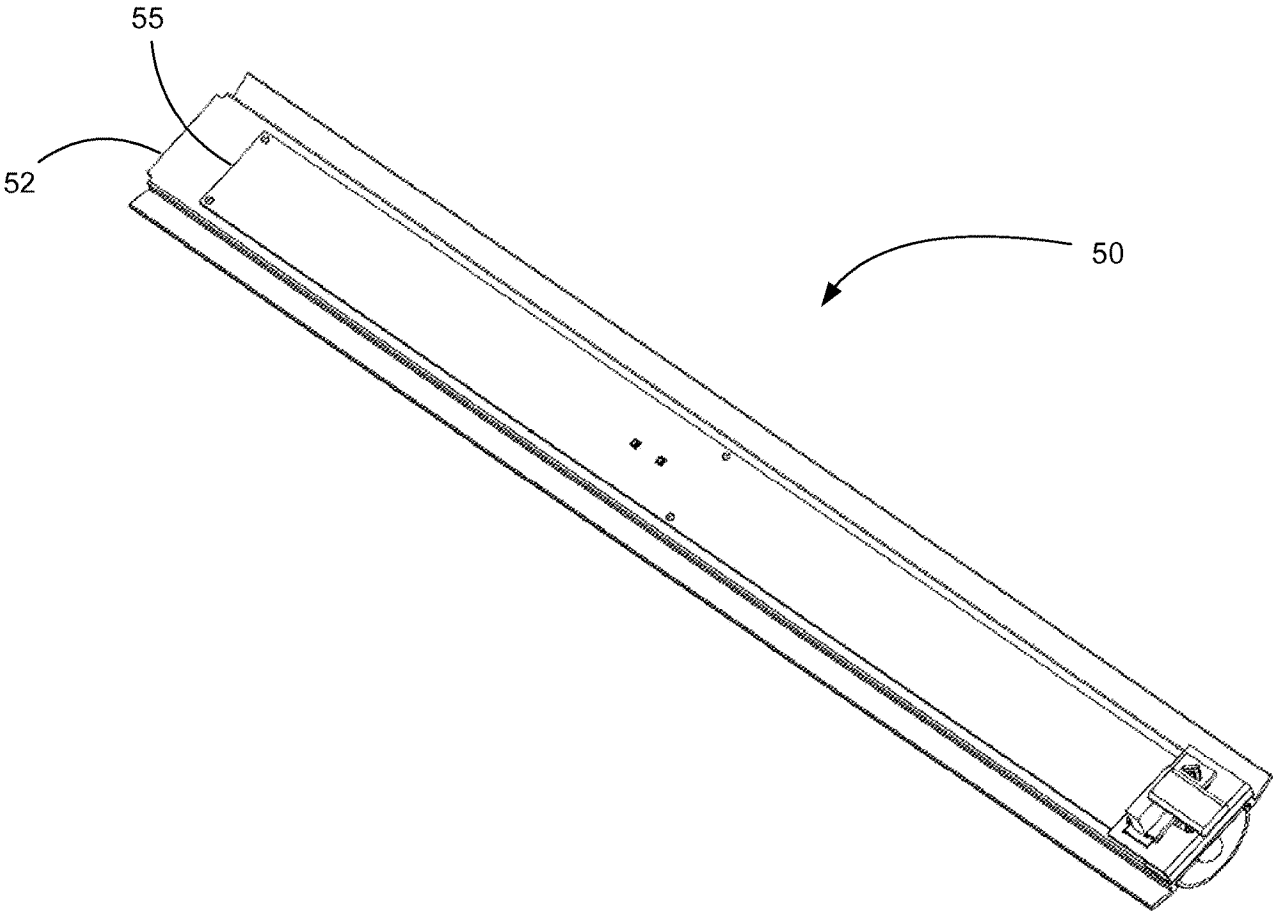
Figure 6:
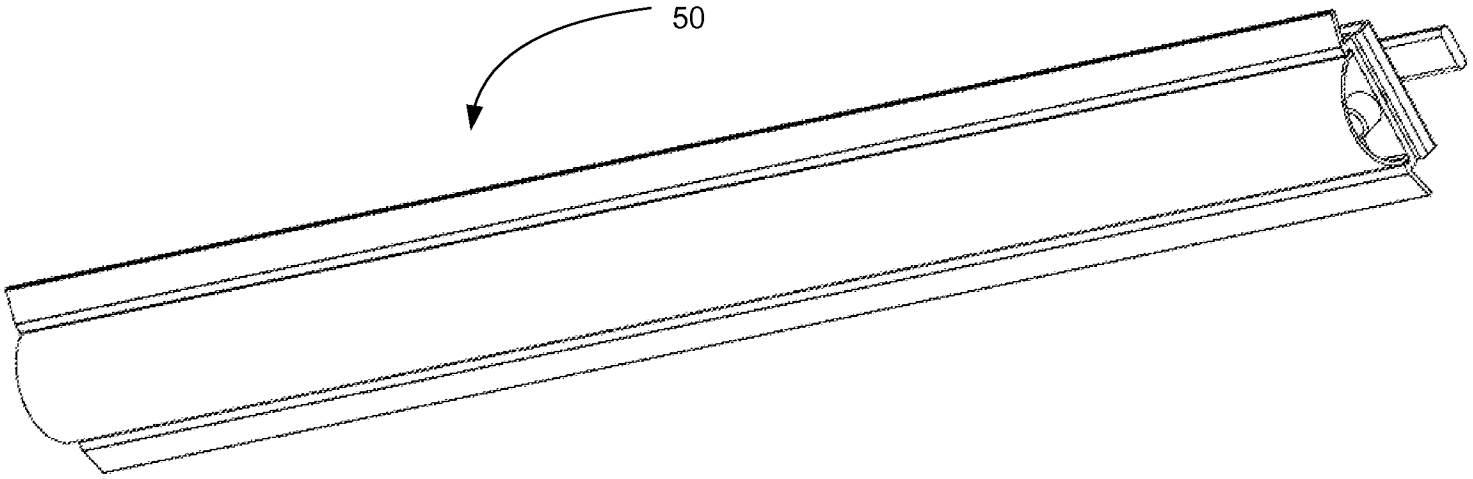
Figure 7:
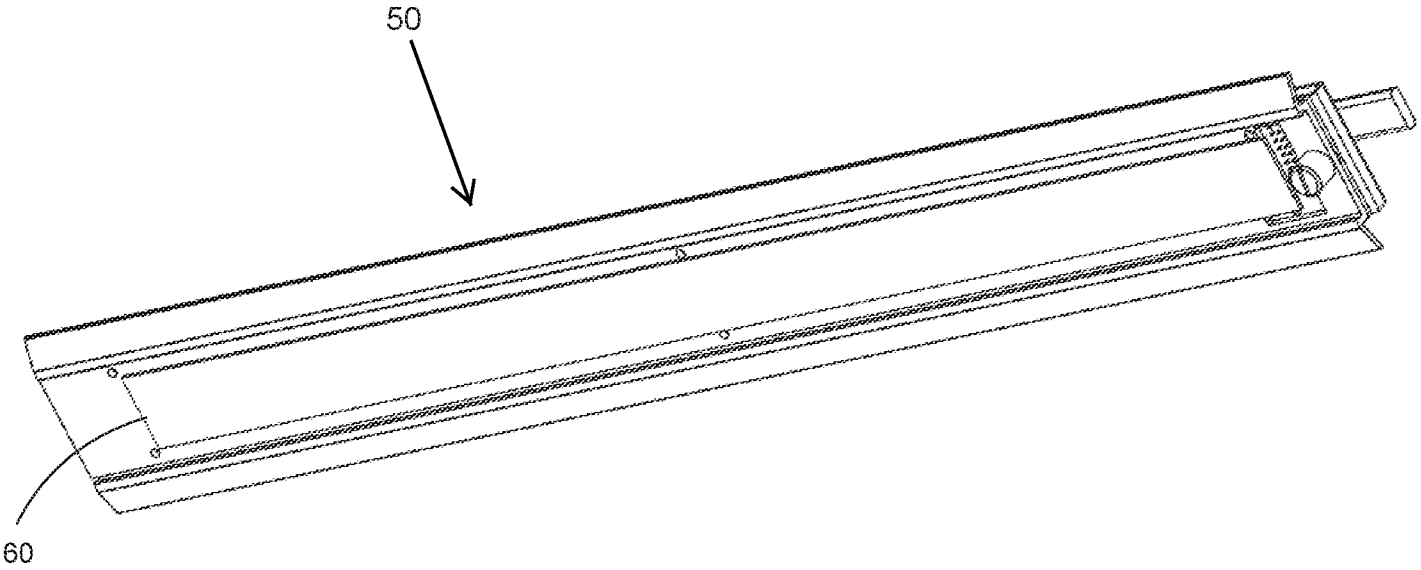
Figure 8:
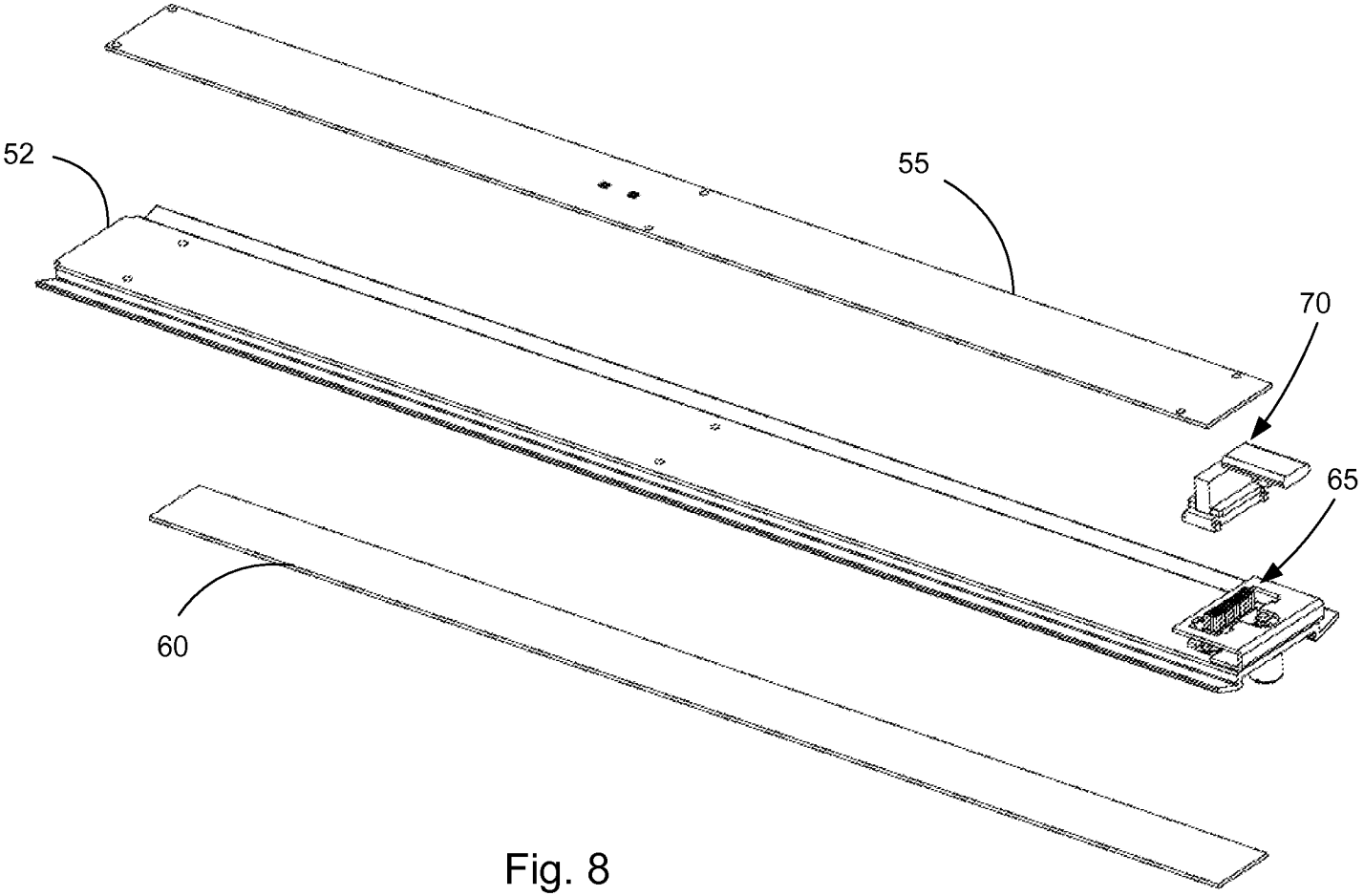
Figure 9:
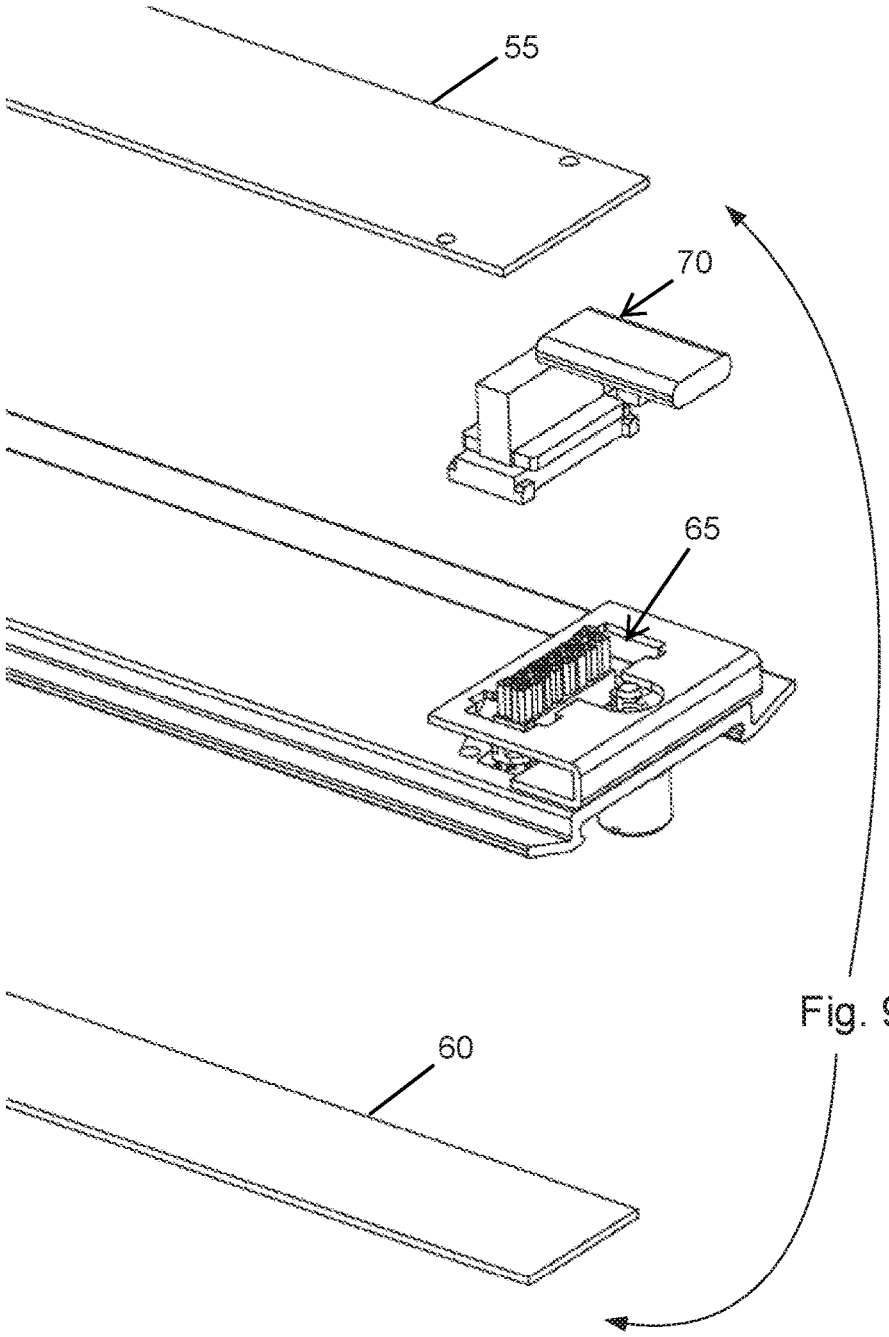
Figure 10:
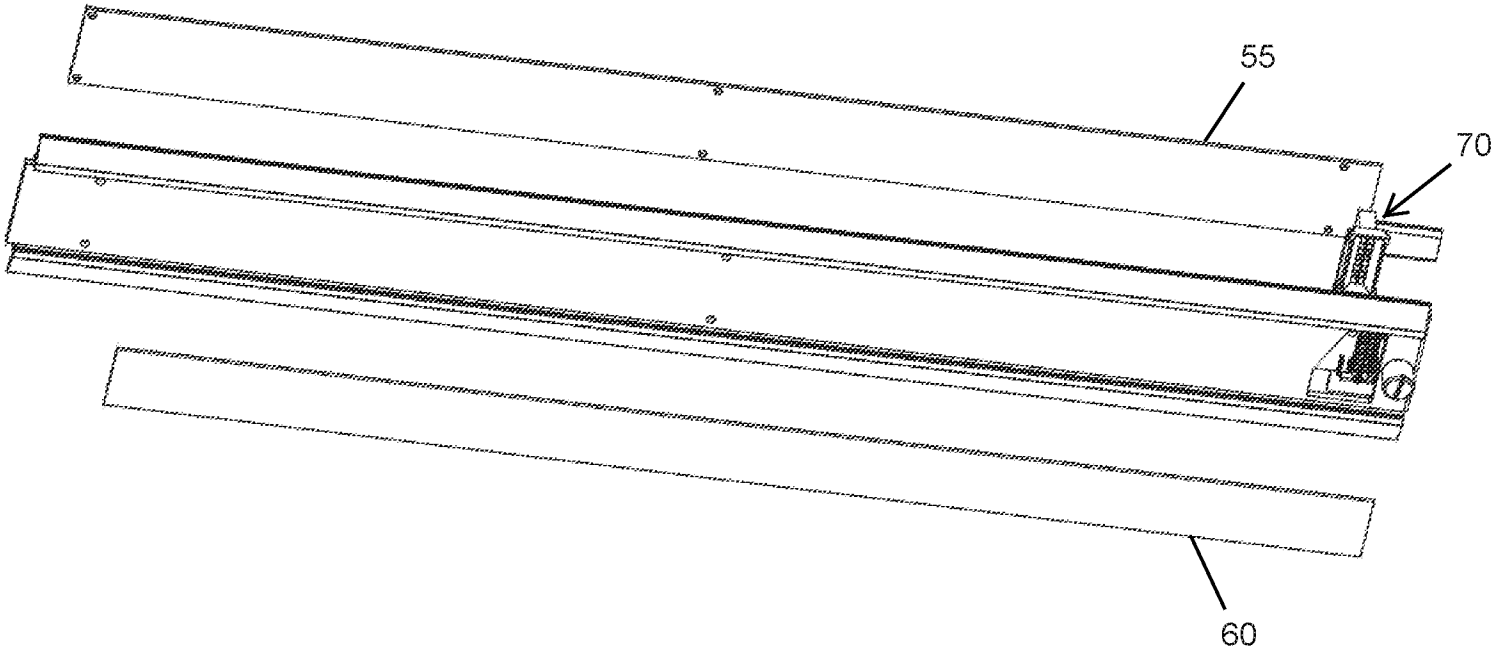

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

A luminaire 10 includes a housing 20 with a reflection chamber 35. The depicted reflection chamber 35 is convex, with a partial circular shape but other shapes may be used as desired and may include angles rather than smooth curves. An optional diffuser 34 is provided to help provide a more diffuse lighting source. The housing 20 supports a rail 50 and the rail 50 includes a connector 65 that is intended to mate with a connector 70 supported by the housing 20. The rail 50 is intended to be removably mated to the housing. In an embodiment, one end of the rail is secured by the housing via a lip or shoulder that supports one end of the rail 50 while the other end is supported by the connector 65.

The rail 50 is positioned so as to be aligned with the reflection chamber 35. The rail 50 has a first side facing the reflection chamber and the first side supports a light board 55 that includes a set of LEDs 57. While two LEDs 57 are depicted for purposes of clarity, in practice it is expected that 4 or more LEDs (preferably more than 10 LEDs) will be provided so as to provide more even illumination. Thus the set of LEDs can have a relatively large number of LEDs if desired. The rail 50 further includes a second side opposite the first side and a display board 60 can be mounted on the second side. The housing supports a second connector 70 that is configured to mate with the first connector. One of the first and second connectors can include a releasable latch that helps hold the first and second connector in a mated condition.

As noted above, the light board 55 includes multiple LEDs in an LED array that can be controlled by a controller. The array will typically include more than two LEDs but there isn't a particular number that is required. The location of the controller that adjusts the output of the LED array can vary, however, depending on the configuration of the luminaire.

In one embodiment, the controller can be integrated into the rail 55. For example, the controller could be mounted on the light board. Naturally such a location is not required and the controller could also be mounted on another board such as a separate circuit board supported by the rail. In an embodiment where the rail supports the controller, the controller can receive various types of input and provides current to the LEDs per its configuration based on the input received. As can be appreciated, such a construction allows the connector to have relatively few inputs (one pair of power inputs and one pair of signal inputs—and if desired the signal inputs could be multiplexed onto the power inputs) while providing a variety of control outputs.

In addition to providing intelligent illumination, the fixture can also provide feedback to individuals within visual or audible range. A pattern of LEDs can be provided on the display board 60 that is mounted on the second side of the rail and a controller can turn on LEDs to provide the desired visual cues. Some sort of sound generating device (such a speaker or transducer) can be provided on the display board to provide audible cues. The display board can be electrically coupled to the first connector so as to be powered thereby.

As can be appreciated, the first and second connectors will typically provide at least two power terminals. The power can be provided from a POE source or other desirable input. The advantage of using a POE source is that the power source is low voltage, which simplifies the entire design of the luminaire and also makes it simple to provide power (one simply runs a network cable to the location and power is provided.

If POE is used to power the luminaire 10 then an RJ45 port (or other suitable port) can be provided in the luminaire 10 along with an appropriate driver.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

We claim:

1. A luminaire, comprising:

a housing with a reflection chamber, the housing configured to be mounted in a ceiling, the housing supporting a first connector;

a rail supported by the housing, the rail including a first side facing the reflection chamber and a second side opposite the first side, the rail including a first end and a second end, the rail including a second connector on the first end that is configured to mate with the first connector; and a light board mounted on the first side of the rail, the light board supporting a plurality of light emitting diodes (LEDs), wherein the LEDs are thermally coupled to the rail and configured to emit light into the reflection chamber, wherein the luminaire is configured to operate via power received from an Ethernet cable providing power over Ethernet (POE), wherein the first and second connectors each comprise at least two power terminals and at least two signal terminals, wherein one of the first and second connectors comprises a releasable latch configured to hold the first and second connector in a mated condition.

2. The luminaire of claim 1, further including a controller integrated into the rail.

3. The luminaire of claim 1, wherein the housing includes an RJ45 port to mate with the Ethernet cable.

4. The luminaire of claim 1, wherein the rail supports a display board on the second side, the display board configured to illuminate a pattern of LEDs in response to a predetermined signal.

5. The luminaire of claim 1, further including a controller configured to control illumination of the plurality of LEDs.

6. The luminaire of claim 1, wherein the controller is mounted on the light board.

7. The luminaire of claim 1, further comprising a cover supported by the housing, the cover aligned with the reflection chamber.

8. The luminaire of claim 1, further comprising a diffuser supported by the rail.

9. The luminaire of claim 1, wherein the second connector is configured to mate with the first connector in a mating direction substantially perpendicular to the first side of the rail.

10. A luminaire, comprising:

a housing with a reflection chamber, the housing configured to be mounted in a ceiling, the housing supporting a first connector;

a rail supported by the housing, the rail including a first side facing the reflection chamber and a second side opposite the first side, the rail including a first end and a second end, the rail including a second connector on the first end that is configured to mate with the first connector; and a light board mounted on the first side of the rail, the light board supporting a plurality of light emitting diodes (LEDs), wherein the LEDs are thermally coupled to the rail and configured to emit light into the reflection chamber, wherein the luminaire is configured to operate via power received from an Ethernet cable providing power over Ethernet (POE), wherein the first and second connectors each comprise at least two power terminals and at least two signal terminals, wherein the rail is supported by the housing via a lip on the second end and the second connector on the first end, when mated with the first connector.

* * * * *